US005397103A

United States Patent [19]

Watson

[11] Patent Number: 5,397,103

[45] **Date of Patent: * Mar. 14, 1995**

[54] TANK LIFTING METHODS

[76] Inventor: Alan R. Watson, P.O. Box 13858, Onehunga Auckland, New Zealand

[ * ] Notice: The portion of the term of this patent subsequent to Aug. 3, 2010 has been disclaimed.

[21] Appl. No.: 62,601

[22] Filed: May 17, 1993

Related U.S. Application Data

[63] Continuation-in-part of Ser. No. 758,687, Sep. 12, 1991, Pat. No. 5,232,202.

[51] Int. Cl.[6] ..... B66F 1/08

[52] U.S. Cl. ..... 254/1; 254/89 H; 254/93 HP

[58] Field of Search ..... 259/1, 89 H, 89 R, 93 HP, 259/93 R, 105, 108, 109, 110, 111

[56] References Cited

U.S. PATENT DOCUMENTS

| | | | |
|---|---|---|---|
| 2,714,011 | 7/1955 | Albee | 280/1 |
| 2,749,592 | 6/1956 | Vartia | 25/155 |
| 2,754,108 | 7/1956 | Brown | 254/1 |
| 3,010,698 | 11/1961 | Allen | 254/2 |
| 3,063,675 | 11/1962 | Allen | 254/2 |
| 4,060,170 | 11/1977 | Walters | 254/93 HP |
| 4,061,310 | 12/1977 | Vetter | 254/93 |
| 4,518,151 | 5/1985 | Dill, Jr. | 254/93 HP |
| 4,807,851 | 2/1989 | De Castro | 254/1 |
| 4,930,750 | 6/1990 | De Castro | 254/89 H |
| 5,232,202 | 8/1993 | Watson | 254/1 |

FOREIGN PATENT DOCUMENTS

| | | | |
|---|---|---|---|
| 1477672A | 5/1989 | U.S.S.R. | 254/93 HP |

OTHER PUBLICATIONS

Hake Company Brochure.

"Movement of Large Storage Tanks on Air," U.S. Hovercraft Society journal, dated Feb., 1993.

"Worker's Relocate 400-Ton Tank," Newark Ohio Advocate, dated Dec. 15, 1989.

*Primary Examiner*—Bruce M. Kisliuk
*Assistant Examiner*—Eileen P. Morgan
*Attorney, Agent, or Firm*—Harris, Tucker & Hardin

[57] ABSTRACT

Large storage tanks are lifted by means of pressurized bags and support members. Tanks may easily and quickly be lifted for inspection, repair and reconstruction. Lifting the tank allows for visual inspection under the tank for corrosion to prevent leakage of environmentally hazardous chemicals stored in the tank. The lifting bags are placed under the tank, inflated, and support timbers placed under the raised tank. The bags are then deflated allowing the tank to rest on the support timbers. The deflated bags are raised by placing support timbers under the bags. The bags are again pressurized further raising the tank. The steps are repeated until the tank is lifted to the desired height. Bags may also be placed under the floor after the wall or rim of the tank is lifted. This does not require cutting holes or welding of supports on the wall or floor. Ground suction is broken by raising one side of the tank with the lifting bags, placing supports as far as possible under the tank rim and depressurizing the bags to rock the other side of the tank off the ground. A fulcrum method is also applied to use the partial weight of the tank as a leverage force to alternately raise opposite sides of the tank.

21 Claims, 4 Drawing Sheets

FIG. 3
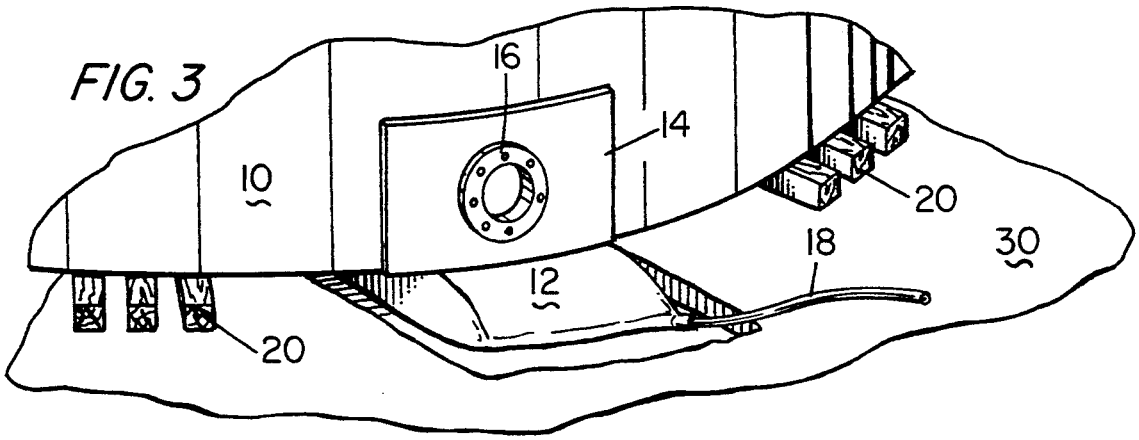
FIG. 4
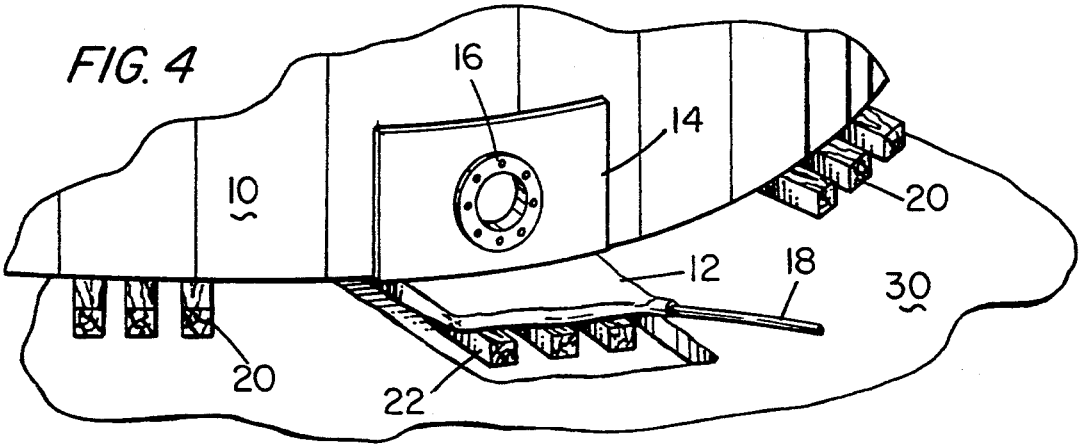
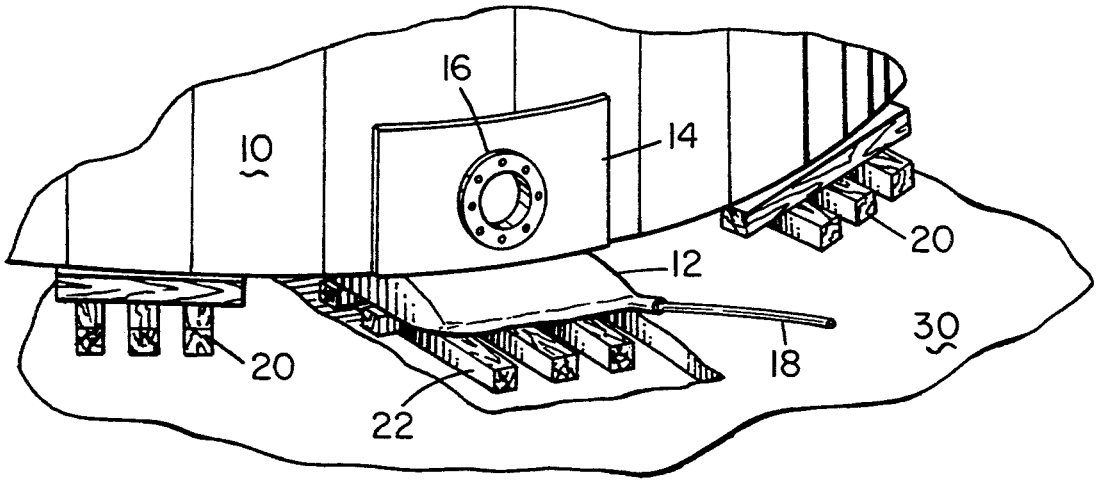
FIG. 5

TANK LIFTING METHODS

CROSS REFERENCE TO RELATED APPLICATIONS

This is a continuation of patent application Ser. No. 07/758,687, filed Sep. 12, 1991, now U.S. Pat. No. 5,232,202, for "Tank Lifting Method" for which benefit is claimed under 35 U.S.C. § 120.

BACKGROUND OF THE INVENTION

The present invention relates to a method for lifting large storage tanks off the ground by using pressurized bags.

Large storage tanks holding environmentally hazardous products require inspection and maintenance to prevent the products from leaking and contaminating the surrounding soil and ground water supplies. Contamination and pollution of soft and water in the area of the tank can cause the owner enormous cleanup expense. Also, the tank can settle into the ground causing water to form pools around the tank increasing the possibility of corrosion.

Inspection and maintenance of the tank requires temporarily draining the tank. It is important that maintenance be done quickly to minimize the loss of valuable storage space. Inspection of the tank floor from inside the tank is highly inaccurate and cannot detect a faulty foundation or corrosion under the tank.

The preferred prior art method to prevent or correct leakage from the tank is to lift the tank so as to inspect and repair the tank floor from underneath the tank. After the tank is lifted, the bottom of the tank floor can be inspected, sand blasted, repainted, and cathodic protection installed. While the tank is lifted, foundation problems can be rectified and the general condition of the foundation can be upgraded. The foundation can be raised to compensate for any settling that has occurred over time. Improvements such as an impervious layer, leakage detectors, and drainage systems can be installed on the tank foundation while the tank is lifted.

Prior methods for tank lifting have required "hot" work, such as welding and torch cutting on the tank to provide attachment points to the tank for the use of hydraulic lifts. This hot work requires degassing the tank to prevent explosions. In a crowded tank farm, the danger of explosion is always present or difficult to control. Moreover, if the tank to be lifted is very large, holes must be cut in the floor of the tank so that the hydraulic lifts can be placed under the center of the tank floor. Thus, there is a need for providing a procedure of lifting storage tanks without encountering the considerable disadvantages of the prior an methods.

BRIEF SUMMARY OF THE INVENTION

The present invention uses pressurized bags to lift the tank. The method is safe, economical, and efficient using only pressurized bags and timbers. No hot work is required so there is no fear of explosion. The bottom of the tank can be fully inspected once the tank has been lifted. Improvements such as sand blasting and painting the bottom of the tank floor and upgrading the foundation can be performed without requiting the tank be degassed. Only if the tank is severely corroded or leaking will hot work be performed requiring precautions against explosion.

In the present method, the tank is lifted a small distance by inflating bags placed under the tank. Then support timbers are placed under the tank and the bags deflated. The bags are then placed on new supports and inflated to raise the tank higher. Since the bags can raise the tank only a few inches in each lift, the lift and support steps are repeated until the tank is lifted to the required working height.

If a large tank is being lifted, structural requirement may not necessitate lifting the floor also. Since the deflated bags are only about two inches thick, the relatively thin unpressurized bags can be slipped under the tank's floor to lift the tank floor as the tank is being lifted thereby eliminating the need to cut holes in the floor.

In a modification of the method, the pressurized bags used to lift the rim or wall of the tank are equipped with load distributing plates which aid in flattening the bags after pressurization in preparation for the next lift, prevent damage to the bags from sharp edges of the tank and help distribute the load over a larger area of the bag and the tank above.

BRIEF DESCRIPTION OF THE DRAWINGS

FIG. 3 is a perspective view showing the pressurized air bag of FIG. 2 lifting the tank off the ground with tank support members adjacent the bag;

FIG. 4 is a side view showing the unpressurized air bags raised on support members ready to begin another lift cycle;

FIG. 5 is a side view showing the pressurized air bags having further lifted the tank;

DESCRIPTION OF THE PREFERRED EMBODIMENT

Figure 1A:
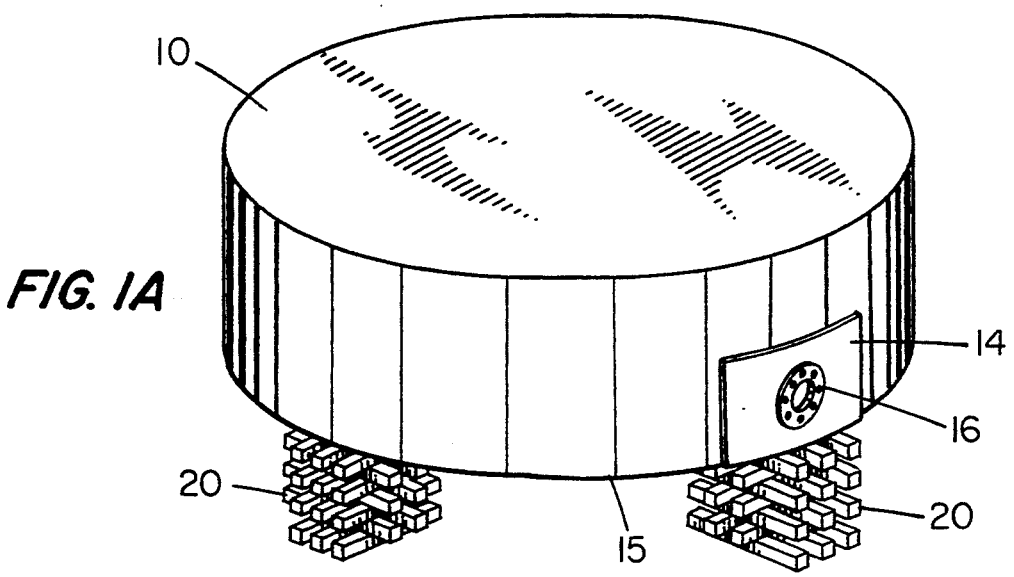
FIG. 1A is a perspective view of a tank lifted by the method of the present invention and sitting on support members.
Figure 1B:
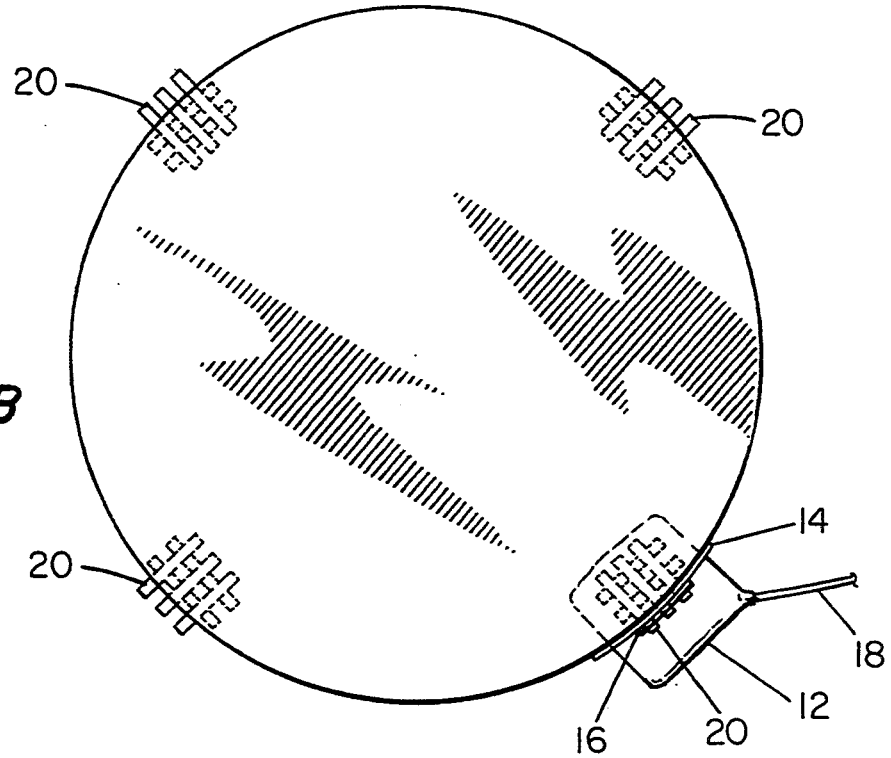
FIG. 1B is a top view of the tank of FIG. 1A.

The object of the present invention is to lift a large storage tank 10 to a level shown in FIG. 1A, preferably 8–10 feet off the ground, so that work may be done on the underside of the tank floor and on the ground beneath the tank. Preferably the tank is supported by tank support members 20 consisting of several layers of a plurality of softwood timbers, each layer being stacked crosswise with the immediate adjacent layers, as shown. Referring to FIG. 1B, the support members 20 are spaced around the periphery of the tank base 15 so as to maintain the tank in a stable, even position. Sufficient support members 20 are used so that selected members may be temporarily removed to enable the entire foundation to be worked on as needed.

Before a storage tank 10 can be lifted, the structural design and condition of the tank must be analyzed to determine the number and placement of lifting bags 12 and tank support members 20 to ensure the tank will be lifted safely and without damage. The analysis includes a determination of the size, weight and shape of the tank, the thickness of its wails, the type of material used, and the age and structural condition of the tank. Other factors to consider include wind loading, earthquake loading and bulk storage loading on the foundation.

Figure 2:
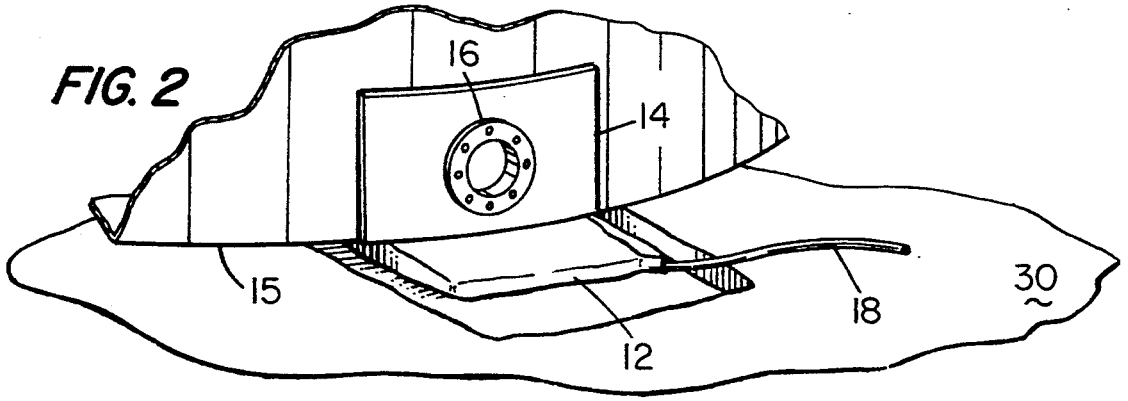
FIG. 2 is a perspective view showing an unpressurized air bag under the edge of the tank of FIG. 1A according to the process of the present invention.

Referring now to FIG. 2, the beginning of the process of the present invention to lift a storage tank is shown. Initially, it is usually necessary to break the suction between the bottom of the tank and the foundation. Therefore, the first lifting bags 12 are preferably placed under the tank 10 at or near the compensating plate 14 or service hole 16, where the tank wall is usually thickest and strongest. The lifting bags 12 are conventional rubber bags manufactured from reinforced interwoven layers of synthetic materials. They preferably are three feet by three feet square by one and one-half inches thick and have a safe working pressure of 120 pounds per square inch (psi). One preferred source for the bags is model V68 bags made by Manfred Vetter Gmbh in Zuelpich-Langendorf, Germany. It is also understood that other pressurized vessels may be used besides bags 12 which are suitable to provide hydraulic lifting according to the present invention. Suitable flexible bags can be pressurized with fluid or gaseous materials, such as air, nitrogen or water.

The tank support members 20 are softwood timbers and their size is determined by the height required to be lifted. The preferable size of the tank support members 20 is six inches by five inches by five feet long. The bag support members 22 are also of softwood timber and their preferred size is six inches by five inches by three feet long. It is understood that other types of support members for the tank and the bags may be used as long as they are suitable to carry out the methods of the present invention.

The pressure required in the bag 12 to lift the tank 10 is controlled by using conventional valves and regulators. Any number of bags can be used at the same time to get complete control over the lifting so no undue stress is created on the tank. Preferably the bags are all filled from a central air supply. The lifting height is preferably controlled from 1/16 inch to twelve inches in any one lift. It is understood that bags 12 may also be filled with water or other fluid suitable to pressurize the bags.

As shown in FIG. 2, to place the lifting bags 12 under the tank 10, a hole three feet wide, extending eighteen inches under the tank and two inches deep into the ground 30, is dug out for each bag. Each bag 12 is then placed in a hole and connected to the control valves and regulators by air hoses 18. The bags 12 are slowly inflated with pressure while watching to see if the tank 10 is lifting away from the ground 30. The pressure applied can be related to the maximum operating pressure for the particular flexible bags which are employed. If ground suction prevents the tank from lifting off the ground, the pressure is stopped at 60% of maximum operating pressure and the pressure in the bags is allowed to pulsate to help break the suction. Should the suction not be broken at 60%, the pressure is increased by 10% and the pulsating repeated until 100% of the operating pressure of the bags is reached. If the tank suction remains unbroken at 100%, then more bags are inserted around the tank perimeter and the process repeated.

Referring now to FIG. 3, when the tank is six inches off the ground 30, tank support members 20 are inserted at calculated points on both sides of each of the bags 12 around the bottom periphery 15 of tank 10. The lifting bags 12 are then deflated by releasing the pressure to leave the tank 10 sitting on the tank support members 20.

As shown in FIG. 4, the bags 12 are removed from under the tank 10 and the bag support members 22 are placed in the same position as the bags. The bags 12 are placed on top of the bag support members 22 and inflated to one hundred psi which lifts the tank 10 another six to twelve inches. A second layer of tank support members 20 is placed cross-wise on top of the existing tank support members 20 as shown in FIG. 5. The bags 12 are then deflated and the tank 10 is supported on the new tank support timbers 20. This process is repeated until the tank 10 has been lifted to the required height off the ground 30, normally four to ten feet as shown in FIG. 1.

Figure 6A:
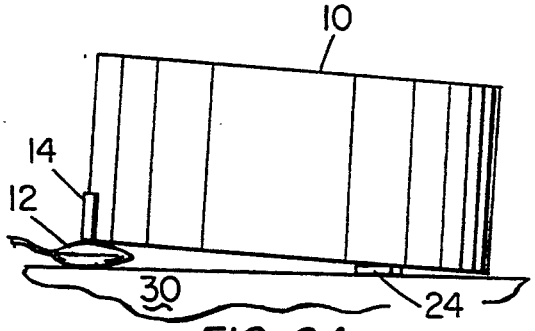
FIGS. 6A–6C are side, top and side views, respectively, showing the rocking method for breaking the suction under the tank in accordance with the present invention.
Figure 6B:
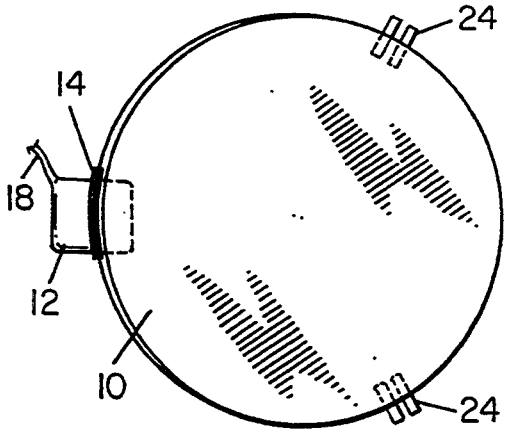
Figure 6C:
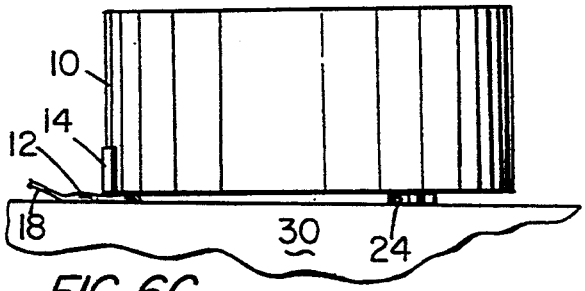

If the ground suction is severe, an alternative preferred rocking method can be used. This approach uses the weight of the tank 10 to break the remaining ground suction once one side has been lifted. Referring to FIGS. 6A and 6B, one or more bags 12 are placed under the adjacent side of the tank 10 below the compensating plate 14 as previously described and shown in FIG. 2. The bags 12 are pressurized until the adjacent side of the tank 10 is about six to eight inches off the ground 30. Then at least two rocking support members 24 are placed on the rim of the tank somewhat across from each other, each being about more than one-fourth of the tank circumference from the bags 12 where the tank 10 is only about two inches off the ground 30. One member 24 is placed in one direction more than one-fourth of the distance around the circumference from the bags and the other member 24 being placed the same distance in the other direction around the circumference from the bags. Preferably the supports are each placed about one-third of the circumference of the tank 10 from bags 12 on opposite sides, as best seen in FIG. **6*b*. Then bags 12 are depressurized and the weight of the tank 10 is used to lift the other side of the tank 10, thereby breaking any remaining ground suction that may exist under the tank 10, as shown in FIG. 6C**.

Figure 7A:
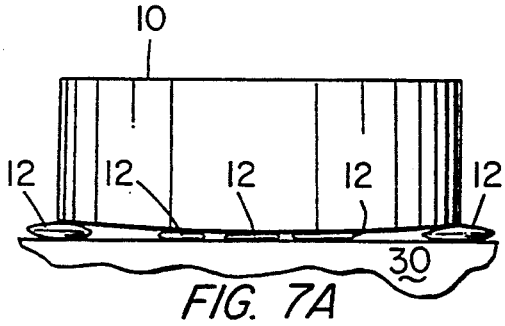
FIGS. 7A–7C show another process of the present invention providing air bags under of the center of the tank floor.
Figure 7B:
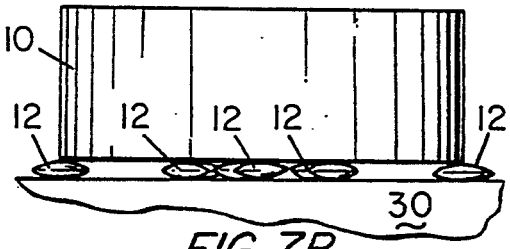
Figure 7C:
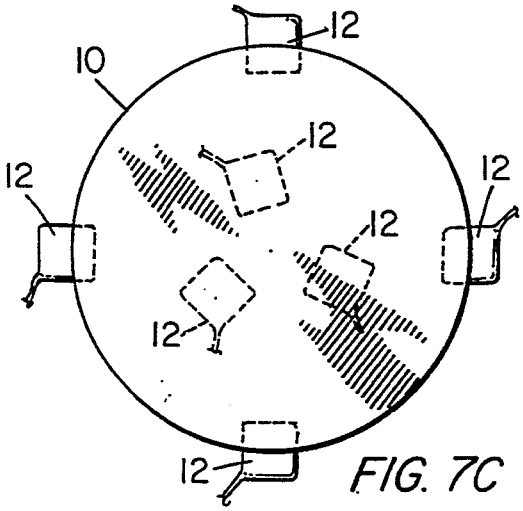

FIGS. 7A to 7C show an alternative procedure for lifting large tanks that need the tank floor 15 supported in the center. This has been a particular problem in the prior art, and many holes are often cut into the bottom of large diameter tanks to provide the required support, using prior art methods.

Using the methods of the present invention, there is no need to cut holes in the tank floor. As shown in FIGS. 7A–7C, additional bags 12 are strategically placed under the floor of the tank 10 as well as around the periphery. As the tank is raised, bag support members are placed to raise the bags so as to continue to support the tank floor. Preferably the tank is raised using only the bags around the periphery of the tank as described above, and the bags under the floor are used primarily for support of the tank floor. When the tank 10 has reached the required height at the perimeter based on design stress calculations, additional bags 12 may be placed under the tank floor 15 as required.

Figure 8:
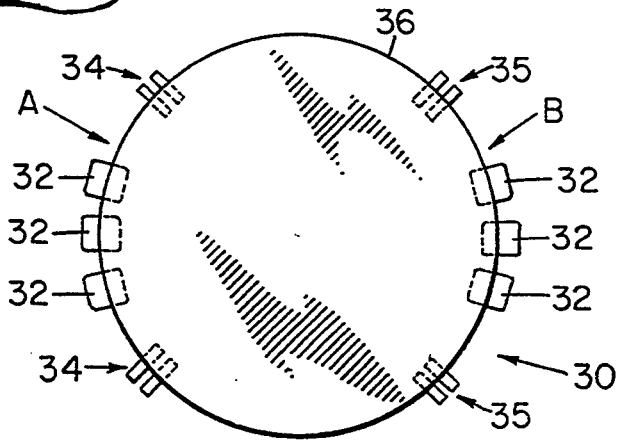
FIG. 8 is a top view of a storage tank showing the fulcrum method of the present invention for lifting tank using fewer bags and support members.

Another preferred method of the present invention is the fulcrum method shown in FIG. 8. Using the fulcrum method, the tank 30 can be lifted to the required height using bags and timbers only at opposite ends of the tank. Thus, this procedure uses less bags and timbers than the previous described processes. One or more bags 32, which are identical to bags 12, are placed near each other under one side A of the tank 30. The bags 32 are then pressurized until side A of the tank is raised about eight inches. Two tank support members 34 are then placed on either side of the tank under the bottom rim 36 of the tank 30, less than one-fourth of the circumference from the bags 32. Then the bags 32 are depressurized and moved to the opposite side B of the tank 30. The opposite side B of the tank 30 is lifted and tank support members 35 are then placed under the opposite side B of the tank 30.

The bags 32 are then depressurized and moved back to side A on top of bag support members (not shown) such as member 22 shown in FIGS. 4 and 5. Preferably the bag support members are high enough so that as the bags 32 are pressurized they will raise tank side A above the tank support members 34. Members 34 are then increased in height to fit just under the tank 30 on side A. The bags 32 are then depressurized and placed under bag support members on side B similar to support member 22. Side B of the tank is lifted by pressurizing bags 32, building up tank supports 35 and depressurizing bags 32. The process is repeated moving the lifting bags to alternate sides of the tank until the tank has been raised to the desired height.

This fulcrum method enables lifting of the tank 30 using a part of the tank's weight as leverage. For example, by lifting tank 30 at side B after support members 34 are in place the lever arm length is shortened to the distance from the bags on side B to members 34 not to side A. Thus, the weight of the part of tank 30 between side A and members 34 provides leverage to help bags 32 lift tank 30 on side B. Bags 32 are then placed back at side A, on top of bag supports to raise the tank further. Leverage to assist this action is provided by the weight from the portion of the tank between supports 35 and side B.

Once the prescribed maintenance has been completed, the tank is lowered by reversing the above described processes.

A variation of the fulcrum method may be visualized by reference to FIGS. 7C and 8.

The general idea is that the rim or wall of the tank can be progressively lifted by sequentially pressurizing vessels, placing tank support members and unpressurizing said vessels progressively around the periphery of the tank. FIG. 7C shows flexible enclosed vessels at the quarter point lifting locations around the circumference. The number of bag placement lifting locations could easily be expanded to the eighth or sixteenths positions or more around the periphery, depending on the size of the tank. More lifting positions would be employed in order to lift larger heavier tanks. Only one group of bags, such as bags 32 in FIG. 8, would be moved and used progressively around the circumferential, quarter, eighth or sixteenth etc. positions to progressively lift the rim of the tank.

For example, the initial lifting could be done at the three o'clock position by pressurizing one or a group of bags 12,32, placing tank support members under the lifted tank, depressing the bags and then moving them to the next progressive adjacent location. The next adjacent progressive lifting position, for example, could be the four thirty position in FIG. 7C where the lifting, supporting and unpressurizing steps would be repeated. This process could continue in a clockwise (or counterclockwise) direction, at the six o'clock, seven thirty o'clock, nine o'clock, ten thirty o'clock, etc., positions progressively in the same direction. The tank rim is progressively and sequentially lifted around the periphery by moving the lifting bags to the next adjacent position under the rim of the tank and lifting there. In so doing, it is desirable to position the tank rim support members so that they will not be directly opposite a future successive lifting location in order to provide stability to the tank while it is being lifted and supported. The process may continue round and round the tank until the desired lifted height is reached.

Figure 9:
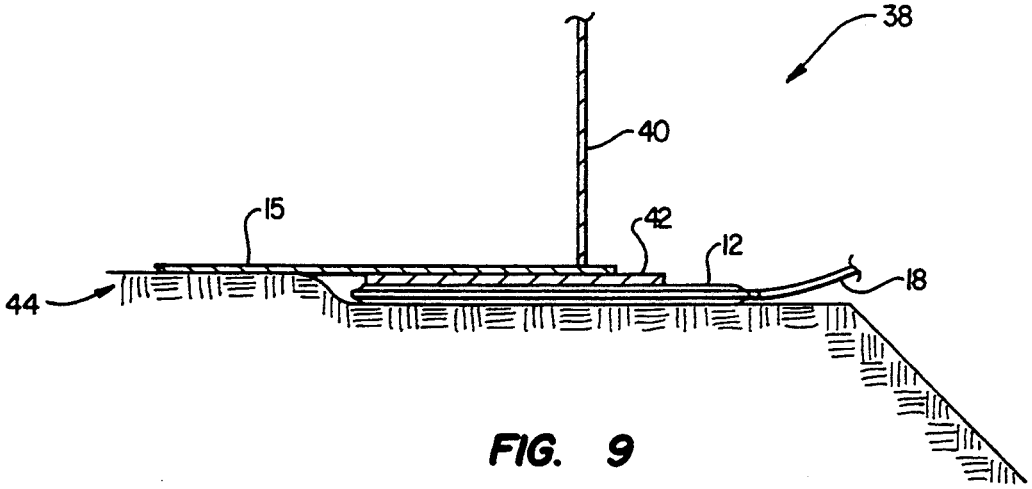
FIG. 9 is a cut-away elevation view showing an unpressurized bag equipped with a load distributing plate underneath the rim or wall of a tank.
Figure 9A:
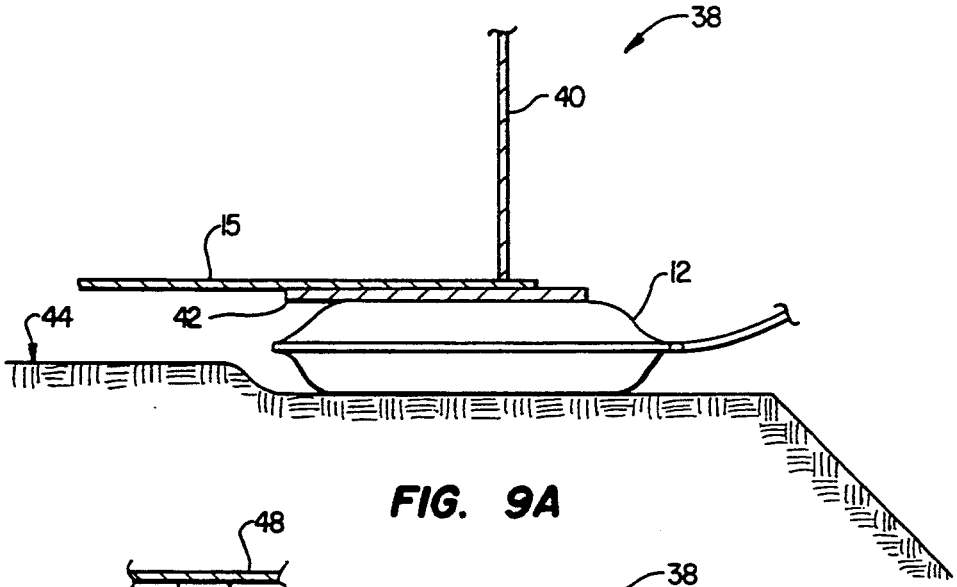
FIG. 9A shows, the bag and load distribution plate of FIG. 9 lifting the rim of the tank when the bag is pressurized.
Figure 9B:
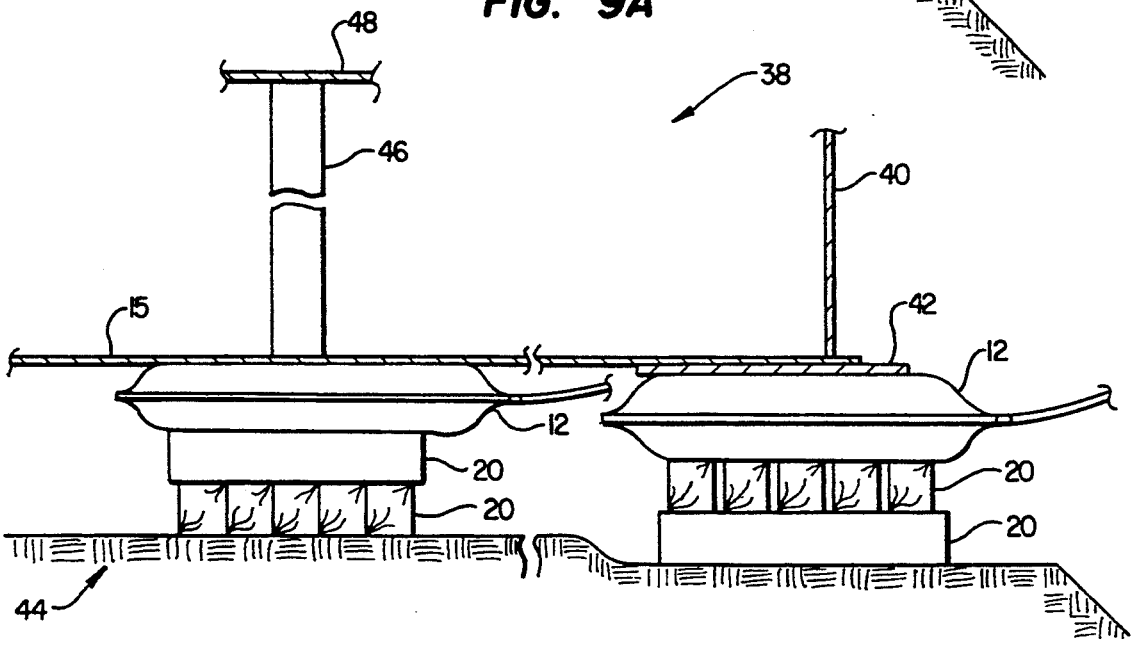
FIG. 9B is a cut-away elevation view showing the pressurized bag of FIG. 9 and 9A supported on vessel support members after several lifts and an additional pressurized bag supported by vessel support members after several lifts, under the floor of the tank at a location directly under a support column often present in tanks to support a cover or roof.

This variation of the fulcrum method can include additional enclosed flexible pressure vessels or bags which are placed under the floor inwardly of the rim of the tank and toward the center of the tank as seen in FIG. 7B, 7C and 9B. After the initial few lifts are made, there is a space created under the floor that permits setting the additional bags. The floor is progressively raised with the additional bags by sequentially pressurizing them to support the floor while the rim is being raised, placing floor supports under the raised floor, depressurizing the additional bags under the floor, and raising them with support members in turn, as the rim is progressively raised and repeating as necessary to control sagging of the floor while the rim is being raised. For example, in FIG. 7C, one group of bags at a given peripheral point under the rim is being pressurized and perhaps only one of the three bags in the center is simultaneously being pressurized to lift the rim and floor together. Preferably the bag or bags under the floor are pressurized which are on the same half of the tank as the ones being used at a given time to lift the rim of the tank.

This process has the advantage that only a few bags need to be provided to do the lifting and they can be carried by a truck which drives around the tank stopping at each of the sequential lifting positions while that part of the rim is progressively lifted. When the initial lift, or perhaps the initial several lifts have been accomplished, it becomes quite easy to insert the flattened unpressurized bags under the rim at the next adjacent lifting position of the rim because the rim there is already lifted a small distance. The lifting process is simplified by reducing or eliminating the need for removing the ground or foundation from the non-initial progressive lifting positions around the periphery as the rim is lifted. The tanks are usually set on gravel or concrete pad foundations which must be excavated slightly as shown in FIGS. 2 and 9B in order to perform the initial lifting operation. A small shallow excavation makes room for the lifting bags as has been previously described.

A modification of the lifting process is illustrated in FIGS. 9, 9A and 9B. In FIG. 9, flexible enclosed unpressurized vessel 12 is flattened and placed under the rim 40 of tank 38 where a slight excavation of foundation 44 has provided space for an initial lift. Bag 12 is equipped with a load distribution plate 42 resting directly thereon under the rim 40 and under part of floor 15 of tank 38.

In FIG. 9A, vessel 12 has been pressurized by inflating, all the while keeping the load distributed on plate 42 while the tank is lifted. Plate 42 evenly distributes the lifting load on the bag, the rim and the outside peripheral area of the floor and protects the bag. Use of plate 42 is especially helpful where through rusting or age, the vertical wall or rim of the tank has been weakened. Distribution of the load over a larger area can help prevent buckling of the tank wall. It has a further advantage in that after the tank is lowered onto support members, the weight of the load distribution plate makes it easier to quickly flatten the bag.

FIG. 9B further illustrates the use of the load distribution plate 42 on a bag at the rim of a tank in combination with use of an additional interiorly spaced bag 12, both of which have been supported on alternately crossed tank support members 20. Bag 12 under the rim is equipped with the load distribution plate 42 because that is where the most weight occurs. The additional bag 12 spaced inwardly from the rim is located directly under the floor in support of column 46 which supports a roof or cover 48. Many tanks have floating covers with support columns 46 which float with the cover or are mounted in the bottom of the tank to keep the cover spaced above the floor 15. It is not generally necessary to use load distribution plates 42 with the additional bags 12 which are used to lift the floor because the floor is much lighter than the wall or rim and thus much easier to lift.

The large tanks often need to have the floor supported and simultaneously raised with the rim else the floor could sag and crack away from the sides of the tank, possibly distorting or damaging wail 40. It is desirable to locate the inner bags 12 directly under support structure 46 which supports the cover 48. FIG. 9B also shows that the bottommost layer of tank support members should be abutted closely together to obtain the maximum support area, whereas the succeeding layers 20 are spaced apart to reduce the need for timbers.

In the preferred mode, the load distribution plates are steel plates approximately 3 feet by 3 feet square and about one half inch thick. This size nicely covers the preferred bag.

Although the foregoing discloses preferred embodiments of the present invention, it is understood that those skilled in the art may make various changes to the preferred embodiments shown without departing from the scope of the invention.

What is claimed is:

1. A method of lifting a tank from its foundation for repairs without the necessity of welding supports on the tank or cutting the floor of the tank, comprising the steps of:

(a) positioning flexible unpressurized vessels under the tank at strategic locations spaced from each other, at least one of said unpressurized vessels being placed under the floor of the tank;

(b) lifting the tank by pressurizing the vessels;

(c) placing tank support members under the lifted tank;

(d) lowering the tank onto the tank support members by depressurizing the vessels;

(e) raising the unpressurized vessels by placing vessel support members under the unpressurized vessels; and (f) repeating steps (b)–(e) until the tank and floor are raised to the desired height.

2. The method of claim 1 wherein the vessels are a plurality of flexible bags.

3. The method of claim 2 wherein the step (b) of lifting the tank by pressurizing the vessels comprises inflating the vessels with air.

4. The method of claim 1 further comprising the steps of:

(g) lowering the tank to the ground by:

(1) pressurizing the vessels to lift the tank off the tank support members;

(2) lowering the tank support members under the tank;

(3) depressurizing the vessels allowing the tank to rest only on the support members;

(4) lowering the unpressurized vessels by lowering or removing the vessel support members under the unpressurized vessels;

(5) repeating steps (1)–(4) until the tank is resting on the ground.

5. The method of claim 1 wherein the lifting steps (a)–(e) further comprise: lifting the tank one side at a time by alternating vessel positions between alternate ends of the tank to reduce the number of vessels and support members needed.

6. The method of claim 1 wherein step (a) is preceded by the step of removing the foundation underneath the rim of the tank to create openings at said strategic locations for sliding the flexible unpressurized vessels under the tank at the strategic locations so that the initial lift can be made with said vessels positioned in said openings.

7. The method of claim 1 wherein the rim of the tank is progressively lifted by sequentially positioning and pressurizing said vessels, placing said tank support members and unpressurizing said vessels at sequential lifting positions spaced around the periphery of the tank.

8. The method of claim 7 wherein the floor of the tank is progressively lifted and supported, as the rim is progressively raised by vessels at said sequential lifting positions spaced around the periphery of the tank, by placing flexible ones of said unpressurized vessels under the floor, pressurizing them to support the floor while the rim is being raised by the vessels at said sequential lifting positions, placing floor supports under the raised floor, depressurizing the vessels under the floor, raising the vessels under the floor with vessel supports and repeating as necessary to control sagging of the floor while the rim is being raised.

9. The method of claim 1 further including the step of placing plates on the unpressurized flexible vessels to distribute the load produced at the rim of the tank when the vessels are pressurized.

10. The method of claim 6 further including the step of placing plates on the unpressurized flexible vessels to distribute the load produced at the rim of the tank when the vessels are pressurized.

11. A method of lifting a tank from its foundation for repairs without the necessity of welding supports on the tank or cutting the floor of the tank, comprising the steps of:

(a) positioning flexible unpressurized vessels under the tank rim at strategic locations spaced from each other;

(b) placing load distribution plates on the flexible unpressurized vessels;

(c) lifting the tank by pressurizing the vessels;

(d) placing tank support members under the rim of the lifted tank;

(e) lowering the tank onto the support members by unpressurizing the vessels;

(f) raising the depressurized vessels and the load distribution plates thereon, by placing vessel support members under the unpressurized vessels; and (g) repeating steps (c)-(f) until the tank is lifted to the desired height.

12. The method of claim 11 wherein the floor of the tank is progressively lifted and supported as the rim is raised by the vessels positioned under the tank rim, comprising placing flexible unpressurized vessels under the floor of the tank, pressurizing them to support the floor while the rim is being raised by the vessels positioned under the tank rim, placing floor supports under the raised floor, depressurizing the vessels under the floor, raising the vessels under the floor with vessel supports and repeating as necessary to control sagging of the floor while the rim is being raised by the vessels positioned under the tank rim.

13. The method of claim 11 wherein the rim of the tank is progressively lifted by sequentially positioning said vessels, pressurizing said vessels, placing said tank support members and unpressurizing said vessels progressively at sequential lifting positions spaced around the periphery of the tank.

14. The method of claim 13 wherein the floor of tank is progressively lifted and supported as the rim is progressively raised by the vessels at said sequential lifting positions spaced around the periphery of the tank, the method comprising placing flexible unpressurized vessels under the floor, pressurizing them to support the floor while the rim is being raised by the vessels at said sequential lifting positions, placing floor supports under the raised floor, depressurizing the vessels under the floor, raising the vessels under the floor with vessel supports and repeating as necessary to control sagging of the floor while the rim is being raised.

15. A method of lifting a tank for repairs without the necessity of welding supports or cutting the tank comprising the steps of:

(a) positioning flexible enclosed unpressurized vessels spaced from each other under the rim of the tank at strategic locations at opposite sides of the tank;

(b) pressurizing the vessels located under one side of the tank to lift one side of the tank;

(c) placing tank support members under the lifted side of the tank;

(d) lowering the lifted side of the tank upon said support members by depressurizing the pressurized vessels;

(e) pressurizing the vessels located under an opposite side of the tank to lift said opposite side of the tank;

(f) placing tank support members under the lifted opposite side of the tank;

(g) lowering the lifted opposite side of the tank upon said tank support members by depressurizing the pressurized vessels;

(h) raising the unpressurized vessels by placing vessel support members under the unpressurized vessels; and (i) repeating steps (b)-(h) until the tank is raised one side at a time to the desired height.

16. The method of claim 15 wherein the vessels are a plurality of flexible bags.

17. The method of claim 16 wherein the step (b) of lifting the tank by pressurizing the vessels comprises inflating the vessels with air.

18. The method of claim 15 further comprising the steps of:

(g) lowering the tank to the ground by:

(1) alternately pressurizing the vessels to lift opposite sides of the tank off the tank support members;

(2) alternately lowering the tank support members under opposite sides the tank;

(3) alternately depressurizing the vessels while the tank is resting on support members;

(4) alternately lowering the unpressurized vessels by lowering or removing the vessel support members under the unpressurized vessels;

(5) repeating steps (1)-(4) until the tank is resting on the ground.

19. The method of claim 15 wherein step (a) is preceded by the step of removing the foundation underneath the rim of the tank to create openings at said strategic locations for sliding the flexible unpressurized vessels under the tank at the strategic locations so that the initial lift can be made with said vessels positioned in said openings.

20. The method of claim 15 further including the step of placing plates on said unpressurized flexible vessels to distribute the load when the vessels are pressurized.

21. A method of lifting from a foundation a large tank having a floor tending to sag when the tank is lifted, comprising the steps of:

(a) positioning unpressurized flexible enclosed vessels under the rim of the tank at strategic locations spaced from each other;

(b) lifting the tank an initial distance from the foundation by pressurizing the vessels positioned in step (a);

(c) positioning additional unpressurized flexible enclosed vessels under the sagging floor of the tank at strategic locations inward from the tank perimeter after the rim is initially lifted;

(d) placing tank support members under the initially lifted rim of the tank;

(e) lowering the lifted side of the tank upon said support members by depressurizing the pressurized vessels under the rim of the tank;

(f) simultaneously pressurizing said vessels and said additional vessels to raise the tank and floor;

(g) placing tank support members under the tank rim and floor;

(h) lowering the tank and floor onto the support members by depressurizing the vessels; and (i) repeating steps (f)-(h) until the tank is raised to the desired height, whereby the tank can be lifted in successive stages with the floor intact without danger of damage to the floor as a result.

* * * * *